United States Patent [19]

Johnson

[11] Patent Number: 4,866,870

[45] Date of Patent: Sep. 19, 1989

[54] REVOLVER SPEED LOADER

[76] Inventor: David A. Johnson, P.O. Box 12204, Salem, Oreg. 97309

[21] Appl. No.: 273,329

[22] Filed: Nov. 18, 1988

[51] Int. Cl.[4] ..... F42B 39/04

[52] U.S. Cl. ..... 42/89

[58] Field of Search ..... 42/89

[56] References Cited

U.S. PATENT DOCUMENTS

| | | | |
|---|---|---|---|
| 1,228,505 | 6/1917 | Wesson | 42/89 |
| 1,559,825 | 11/1925 | Wilson | 42/89 |
| 1,929,440 | 10/1933 | Miano | 42/89 |
| 3,197,907 | 8/1965 | Olson | 42/89 |
| 4,065,868 | 1/1978 | Johnson | 42/89 |
| 4,133,129 | 1/1979 | Jelinck et al. | 42/89 |

*Primary Examiner*—Charles T. Jordan

*Attorney, Agent, or Firm*—Charles N. Hilke

[57] ABSTRACT

A holder for releasable securement of cartridges in condition for simultaneous loading of the cartridges into the chambers of a revolver's cylinder. The holder comprises the cylindrical body, having a plurality of axially extending, radially distributed cartridge-receiving bores adapted to align with and introduce the rounds into the revolver's cylinder chambers. The holder also includes a locking device which holds the cartridges by the rims of the cartridges, and this locking device can be released automatically as the cartridges are introduced into the chambers of the revolver. A free rotating sleeve allows the rotation of the holder such that the cartridges slide easily into the revolver. A plurality of legs attached to the holder allow for positioning the holder in proper alignment with the revolver's cylinder without touching projections of the revolving cylinder or the revolver itself.

2 Claims, 2 Drawing Sheets

FIG. 1
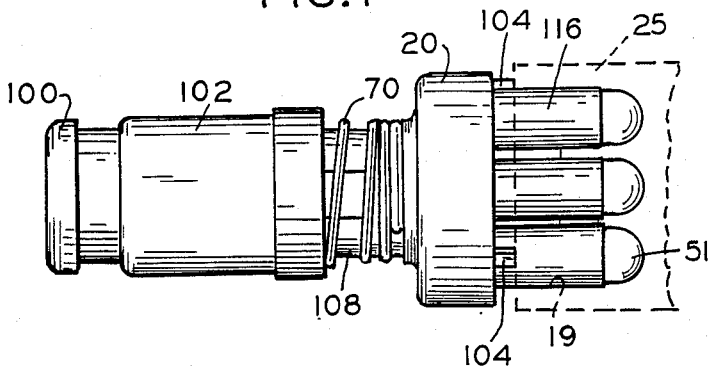
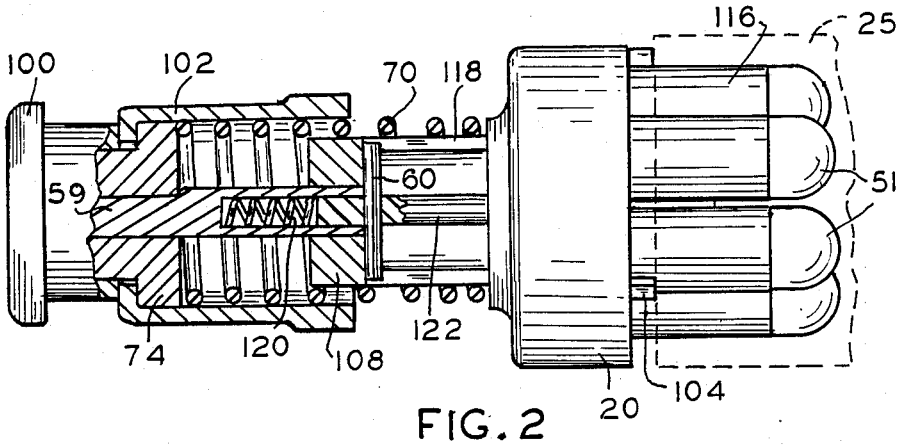
FIG. 2
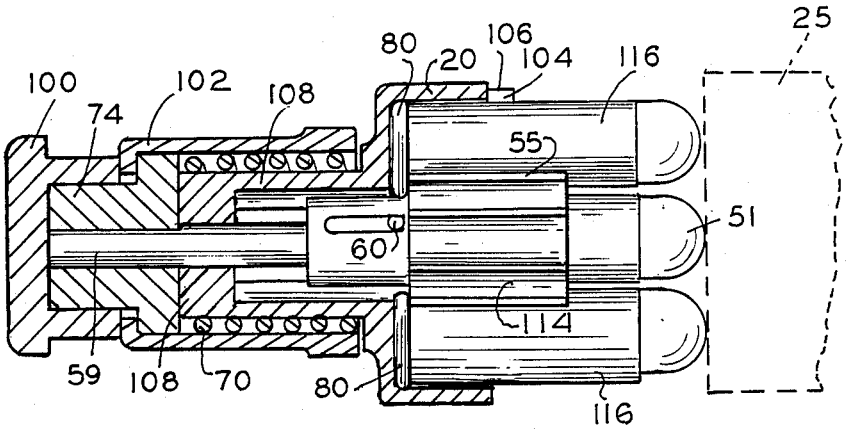
FIG. 3

FIG. 5
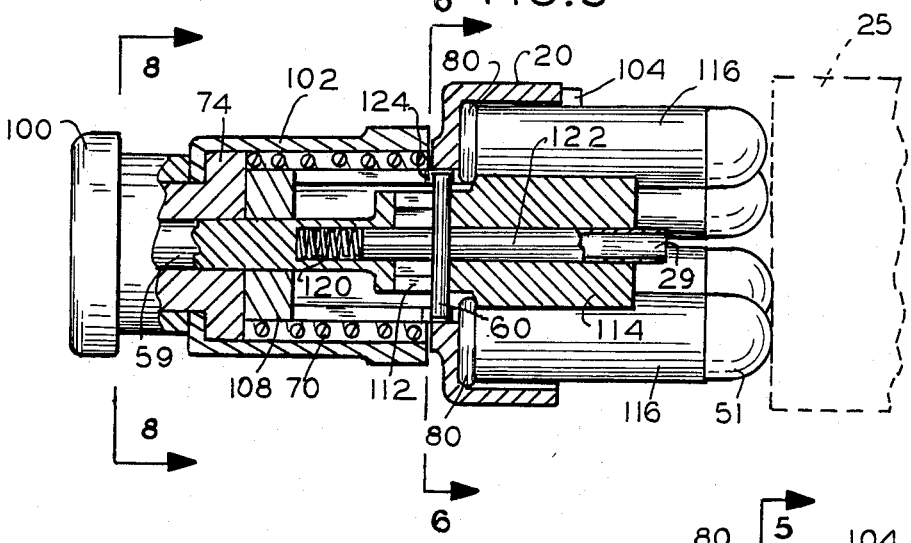
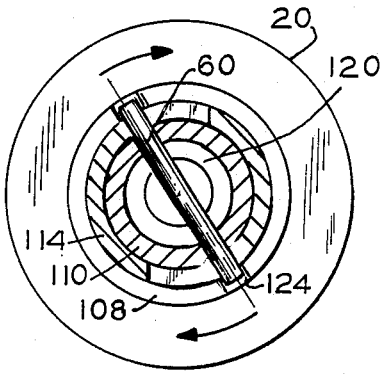
FIG. 6
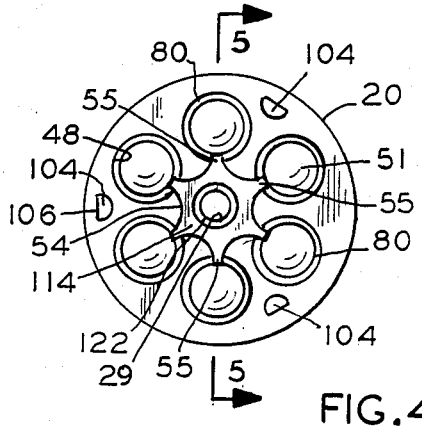
FIG. 4
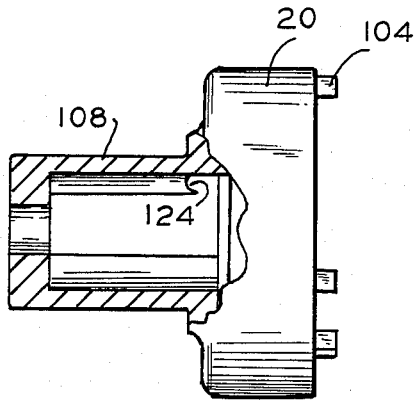
FIG. 7
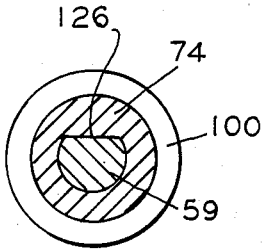
FIG. 8

REVOLVER SPEED LOADER

FIELD OF THE INVENTION

The invention relates to a rapid loading device for revolvers, wherein the cartridges can be retained by their rims in a loading drum by means of radial extended portions of a wheel sprocket and can be inserted into the chambers of the revolver's drum by means of spring force.

BACKGROUND OF THE INVENTION

This invention is an improvement upon the inventor's prior U.S. Pat. No. (4,065,868) and upon Jelinek's U.S. Pat. No. (4,133,129) of which the inventor is the assignee of the rights contained therein. Jelinek's primary advantage over the inventor's prior invention is the automatic release feature which allows for the insertion of the cartridges into the revolving cylinder such that pin 18 is pressed against the revolver's drum thereby automatically forcing the cartridges into the revolving drum and releasing the cartridges from the holder. The spring 5 is a central compression spring which is also a tortion spring.

The use of the Johnson model and the Jelinek model disclosed two concerns with respect to the rapid loading feature. Because of the wide variety of revolvers to which the speed loading device is used, certain projections on some revolvers would cause a twisting or a turning of the holder with 7 respect to the revolver's cylinder. This, in some cases, would cause jamming or noninsertion of the cartridges into the revolving cylinder. An additional problem was the fact that the person loading the revolver would functionally grip the holder such that the release of the cartridges was impeded by restricting the rotation of the holder. This also slowed the actual operation of the speed loader.

SUMMARY OF THE INVENTION

According to the invention, the disadvantages disclosed in the prior Johnson patent and the Jelinek patent are solved by adding to the one face of the holder a plurality of legs designed to provide clearance around various projections of a revolver. The plurality of legs are specifically designed to provide aligned stability of the holder with the revolving cylinder. The legs are positioned and designed in the shape of a half moon to provide the necessary clearance. Furthermore, according to the invention, a free rotating sleeve is added to cover the tortional spring which allows the free rotation of the holder as insertion of the cartridges in the holder occurs into the chambers of the revolving cylinder.

It is an object of this invention to provide proper alignment of the holder with respect to the revolver's cylinder for many different revolvers.

It is another object to provide a freely rotating sleeve to assist in the insertion of the cartridges into the revolver's cylinder.

It is another further object to provide easily manufactured and aligned parts for the rapid construction of the holder.

Yet further features and advantages of the present invention will become apparent, and the full nature of the invention will be more readily understood from the accompanying drawings and the following descriptions and claims.

BRIEF DESCRIPTION OF THE DRAWINGS

FIG. 1 is a side view of the holder with the cartridges inserted into the revolver's cylinder shown in ghost lines.

FIG. 2 is a cutaway view of the operational features of the holder.

FIG. 3 is another cutaway view of the holder specifically showing the pin positioning mechanism prior to insertion into the revolver's cylinder.

FIG. 4 is a front view of the holder mechanism where the cartridges are present.

FIG. 5 is a cutaway view along lines 5—5 of FIG. 4 showing further details of the holding mechanism.

FIG. 6 is a view along lines 6—6 of FIG. 5 showing details of the holding device.

FIG. 7 is a side cutaway view of the holder mechanism itself with the legs showing.

FIG. 8 is a view along lines 8—8 of FIG. 5 showing the end cap with the alignment manufacturing feature.

DETAILED DESCRIPTION OF THE INVENTION

In FIG. 1 the cylinder shaped body 20 is shown holding the cartridges 51 which have been inserted into the cylinder chamber 19 of the revolver cylinder 25. The legs 104 projecting from the cylinder shaped body 20 are in contact with the face of the revolver cylinder 25. The spring 70 surrounds the positioning cylinder 108 which projects from the cylinder shape body 20. The end cap 100 holds the free rotating sleeve 102 about the spring 70.

Reviewing FIG. 2 the actuator 122 is shown positioned within the positioning cylinder 108 with the actuator spring 120 within the shank 59. The shank 59 is shown positioned within the lock actuator 74 with the end cap 100 around the lock actuator 74. The spring 70 is shown extending upward towards the end cap 100 within the free rotating sleeve 102.

FIGS. 3 and 5 shows the pin 60 in the mid shank slot 112 of the mid shank 110. The pin 60 is in its locked position. The actuator 122 is shown extending from the wheel sprocket 114.

FIG. 4 shows the cylindrically shaped body 20 with the cartridges 51 within the bores 48. The cartridge flanged edges 80 are shown held in locked position by the wheel sprocket 114 by means of the radial extended portions 55. The wheel sprocket indentations 54 are shown. Furthermore, the actuator 122 with the female socket 29 is shown within the wheel sprocket 114. The legs 104 are shown with the flat face 106. Three legs 104 are shown equally spaced apart by 120°. The flat face 106 does not extend closer to the end of cylinder 20 than the closest portion of the bore 48.

FIG. 5 shows the cylindrically shaped body 20 holding the cartridges 51. The shell 116 of the cartridge is shown. The actuator 122 extends out of the wheel sprocket 14 and continues through the mid shank 110 and into the shank 59 where actuator spring 120 is positioned. The pin 60 is fixably positioned to the actuator 122 where the pin extends through the mid shank slot 112. The free rotating sleeve 102 completely covers the spring 70 as the speed loader is ready for insertion into the revolver cylinder not shown. The positioning cylinder 108 holds the shank 59 as it extends into the lock actuator 74. The mid shank 110 is shown positioned between the shank 59 and the wheel sprocket 114. The positioning cylinder slot 118 is shown such that the pin 60 can extend through the positioning cylinder 108 into locked position 124.

FIG. 6 shows the cylindrically shaped body 20 from which the positioning cylinder 108 extends. A portion of the wheel sprocket 114 is shown with the mid shank 110 within which the actuator 122 can move axially but not rotationally. The pin 60 is shown as fixably held by the actuator 122 and through the mid shank slot 112 of the mid shank 110. Also shown is the positioning cylinder slot 118 through which the pin 60 can move into locked position shown as number 124.

FIG. 7 shows the cylindrically shaped body 20 with the legs 104 extending therefrom and the positioning cylinder 108 extending in opposite relationship.

FIG. 8 shows the alignment of shank 59 by means of the auto-alignment 126 within the lock actuator 74. The end cap 100 holds the lock actuator 74.

In operation wheel sprocket 114 is positioned such that the wheel sprocket indentations 54 coincide with the bore 48 in the cylinder shaped body 20. The spring 70 is in its extended position as shown in FIG. 1. After the cartridges 51 have been placed into the bores 48 of the cylinder 20 the end cap 100 is pushed towards the cylindrically shaped body 20 and turned through approximately 30° which causes the wheel sprocket 114 to rotate through approximately 30° such that the radial extended portions 55 lock the cartridge flanged edges 80. As this occurs, the pin 60 is rotated by means of the mid shank 110 because of the fixably positioned shank 59 within the lock actuator 74 to which the end cap 100 is fixably attached. This causes the pin 60 to lock in position 124. Additionally, the actuator 122 extends beyond the face of wheel sprocket 114 because of the axial movement of the end cap 100 towards the cylindrically shaped body 20.

To insert the cartridges 51 into the revolver cylinder 25 the speed loader is held by the free rotating sleeve 102 and end cap 100. As the speed loader is moved towards the revolver cylinder 25 the cartridges will begin to move into the cylinder chamber 19 within the revolver cylinder 25. If the cartridges 51 are misaligned, the cartridges themselves in contact with the cylinder chamber 19 will cause the cylindrically shaped body 20 to rotate about the free rotating sleeve 102. The cartridges 51 continue to move into the cylinder chambers 19 until the actuator 122 touches the revolver cylinder 25. As insertion continues, actuator 122 is moved towards the end cap 100 which then releases the pin 60 from its locked position 124 and causes the actuator 122 to rotate in cooperation with the spring 70 which is torsionally loaded. By holding only the free rotating sleeve 102, the rotation occurs unimpeded. The spring 70 also causes the cylindrically shaped body 20 to extend rapidly towards the revolver cylinder 25 until the legs 104 touch the revolver cylinder 25. At this point the operator withdraws the cylindrically shaped body 20 from the revolver cylinder 25. Because of the positioning of the legs 104, any projections or protrusions extending from the revolver near the revolver cylinder will not interfere with the insertion of the cartridges 51 into the cylinder chambers 19.

Thus, as can be readily appreciated, the operator does not impede the rotational movement of the lock release means as the cartridges 51 are inserted into the cylinder chamber 19, and furthermore, the legs 104 with the flat face 106 of the leg prevent twisting during the rapid release of the spring 70 compression.

The terms and expressions which have been employed in the foregoing abstract and specification are used therein as terms of description and not of limitation, and there is no intention, in the use of such terms and expressions, of excluding equivalence of the features shown and described or portions thereof, it being recognized that the scope of the invention is defined and limited only by the claims which follow.

I claim:

1. A rapid loading device for loading a plurality of cartridges having rims at their rear ends into a revolver, the device comprising:

a. a body member having front and rear opposing surfaces, and means defining a center bore extending generally perpendicularly to said front and rear opposing surfaces and a plurality of cartridge-receiving bores radially distributed around said center bore, each of said plurality of bores extending parallel to said center bore and having a diameter greater than that of said flanged peripheral edges of said cartridges and suitable for receiving and supporting one of said cartridges, said body member and said cartridge-receiving bores being of such a length as to cause the leading ends of said cartridges to protrude from said front surface of said body member when supporting said cartridges;

b. cartridge locking means mounted in said center bore of said body member for releasably securing and laterally supporting said cartridges in said plurality of bores and centrally positioning said cartridges in said plurality of bores;

c. lock release means mounted in said cartridge locking means extending beyond said cartridge locking means; and d. a plurality of legs extending from said front face of said body member such that a flat face cut into the outer side of said leg for clearance where said legs extend less than said lock release.

2. The rapid loading device of said claim 1 additionally comprising:

e. a free rotating sleeve rotatable about a positioning cylinder extending from said rear surface of said body member, said cartridge locking means, and said lock release means.

* * * * *